US007107892B2

(12) United States Patent
Dong

(10) Patent No.: US 7,107,892 B2
(45) Date of Patent: Sep. 19, 2006

(54) HOUSING WITH MULTIPLE CASE DRAIN PORTS FOR HYDROSTATIC TRANSMISSION PUMPS

(75) Inventor: Xingen Dong, Greeneville, TN (US)

(73) Assignee: Parker-Hannifin, Cleveland, OH (US)

( * ) Notice: Subject to any disclaimer, the term of this patent is extended or adjusted under 35 U.S.C. 154(b) by 90 days.

(21) Appl. No.: 10/802,278

(22) Filed: Mar. 17, 2004

(65) Prior Publication Data

US 2004/0191075 A1 Sep. 30, 2004

Related U.S. Application Data

(60) Provisional application No. 60/458,109, filed on Mar. 26, 2003.

(51) Int. Cl.
*F01B 31/18* (2006.01)

(52) U.S. Cl. ..... 92/12.2; 92/86

(58) Field of Classification Search ..... 60/585; 92/12.2, 82, 86; 417/434
See application file for complete search history.

(56) References Cited

U.S. PATENT DOCUMENTS

| | | | | |
|---|---|---|---|---|
| 3,361,077 | A * | 1/1968 | Frank | 92/86 |
| 3,810,715 | A | 5/1974 | Week et al. | |
| 3,908,519 | A * | 9/1975 | Born et al. | 92/12.2 |
| 4,793,774 | A * | 12/1988 | Bradt et al. | 92/12.2 |
| 5,794,515 | A * | 8/1998 | Bethke | 92/12.2 |
| 5,845,559 | A * | 12/1998 | Schroeder et al. | 92/12.2 |
| 6,332,393 | B1 | 12/2001 | Trimble | |
| 6,494,686 | B1 | 12/2002 | Ward | |
| 6,502,394 | B1 | 1/2003 | Trimble | |
| 6,526,748 | B1 | 3/2003 | Trimble | |

* cited by examiner

*Primary Examiner*—Edward K. Look
*Assistant Examiner*—Michael Leslie
(74) *Attorney, Agent, or Firm*—Daniel J Whitman; Joseph J. Pophal

(57) ABSTRACT

In a variable displacement hydraulic pump having a housing with a multiplicity of interconnected surfaces, including opposed end surfaces and intermediate side surfaces, the improvement comprising the location of at least one case drain orifice in each of a plurality of differing ones of the surfaces in a manner such that at least one of the orifices is located in the vicinity of the top surface of the housing in any spatial orientation of the housing.

13 Claims, 6 Drawing Sheets

HOUSING WITH MULTIPLE CASE DRAIN PORTS FOR HYDROSTATIC TRANSMISSION PUMPS

CROSS-REFERENCE TO RELATED CASES

The present application claims the benefit of the filing date of U.S. Provisional Application Ser. No. 60/458,109; filed Mar. 26, 2003, the disclosure of which is expressly incorporated herein by reference.

FIELD OF THE INVENTION

The present invention relates to a housing for a variable displacement hydraulic pump and particularly to the case drain orifices in the housing of a light duty pump.

BACKGROUND OF THE INVENTION

The present invention relates to hydraulic pumps, and in particular to light duty pumps. Light duty pumps are typically used in hydrostatic transmissions for turf equipment propulsion systems.

Pumps, both conventional and light duty, have numerous ports for receiving connectors of fluid lines that link with the motor, reservoir, and components. One of these ports is the case drain port which connects with the case drain line that leads to the reservoir. Typically this fluid line is inflexible and is routed to mate with the pump in a designated area. When the pump does not have a port in the designated area, an adapter and extra conduit is needed to reach this other location. This is an obstacle for the mechanic when connecting the lines.

Also, it is preferable to have the port connection located in an area that is easy to access. Typically this is the top side of the pump. Port connections located in side and bottom surfaces can be difficult to access due to the limited space available. Access is needed since the pump has to be removed from the equipment when it undergoes routine maintenance or when it needs to be replaced. It is an obstacle when the port connection is located in a difficult to reach location.

Most prior art conventional pumps use one case drain port on one surface of the pump housing. An example of such a pump is shown in prior art reference U.S. Pat. No. 3,810,715 to Week et al. Conventional pumps are typically installed in a fixed direction with its shaft directed horizontally. Other prior art conventional pumps have two case drain orifices located on the top and bottom surfaces of the pump housing. This design provides more flexibility with routing to the case drain port for pumps that have the shaft directed horizontally.

Light duty pumps are less heavy than conventional pumps and can have multiple orientations. Unlike the conventional pumps, light duty pumps can have its shaft positioned upwards and downwards. For case drain line routing purposes it is advantageous to have a port accessible in each routing. Certain prior art light duty pumps have multiple ports, but these are located in the endcap of the pump. Examples of these pumps are shown in U.S. Pat. No. 6,332,393 B1 to Trimble and U.S. Pat. No. 6,494,686 B1 to Ward. The disadvantage with these style pumps is that when the pump shaft is directed upwards, the endcap and case drain orifice is on the bottom of the pump and difficult to access.

SUMMARY OF THE INVENTION

The present invention provides a housing for a variable displacement hydraulic pump having a total of six side portions comprised of an open first longitudinal end, a spaced, open second longitudinal end, and four adjoining radial sides connecting the longitudinal ends. The housing further has a porting system with at least one case drain orifice in at least two differing ones of the six side portions. A further feature of the present invention has the variable displacement pump being of a light duty variety.

Another feature of the noted housing has one of the at least one case drain orifice located in an upwardly-directed generally horizontal surface position, regardless of the spatial orientation of the housing. A further feature of the noted housing has one of the at least one case drain orifice located at an upper-most section of the housing in any spatial orientation of the housing. Still a further feature of the noted housing has one of the at least one case drain orifice located at a front-most section of the housing in any spatial orientation of the housing. Yet another feature of the noted housing has one of the at least one case drain orifice located at the rear-most section of the housing in any spatial orientation of the housing. A further feature of the noted housing has one of the at least one case drain orifice located at a bottom-most section of the housing in any spatial orientation of the housing. Further features and advantages of the present invention will become apparent to those skilled in the art upon review of the following specification in conjunction with the following drawings.

DETAILED DESCRIPTION OF THE INVENTION

The present invention relates to a hydraulic pump, and in particular to a light duty pump 10 used, for example, in a hydrostatic transmission. Pump 10 is of the axial piston design and combines with a motor, not shown, and other accessories to comprise the hydrostatic transmission. Pump 10 is a variable displacement pump and is typically used in turf equipment propulsion systems. As is well known in the art, a variable displacement pump enables the equipment to smoothly transition from neutral to forward or reverse.

Figure 1:
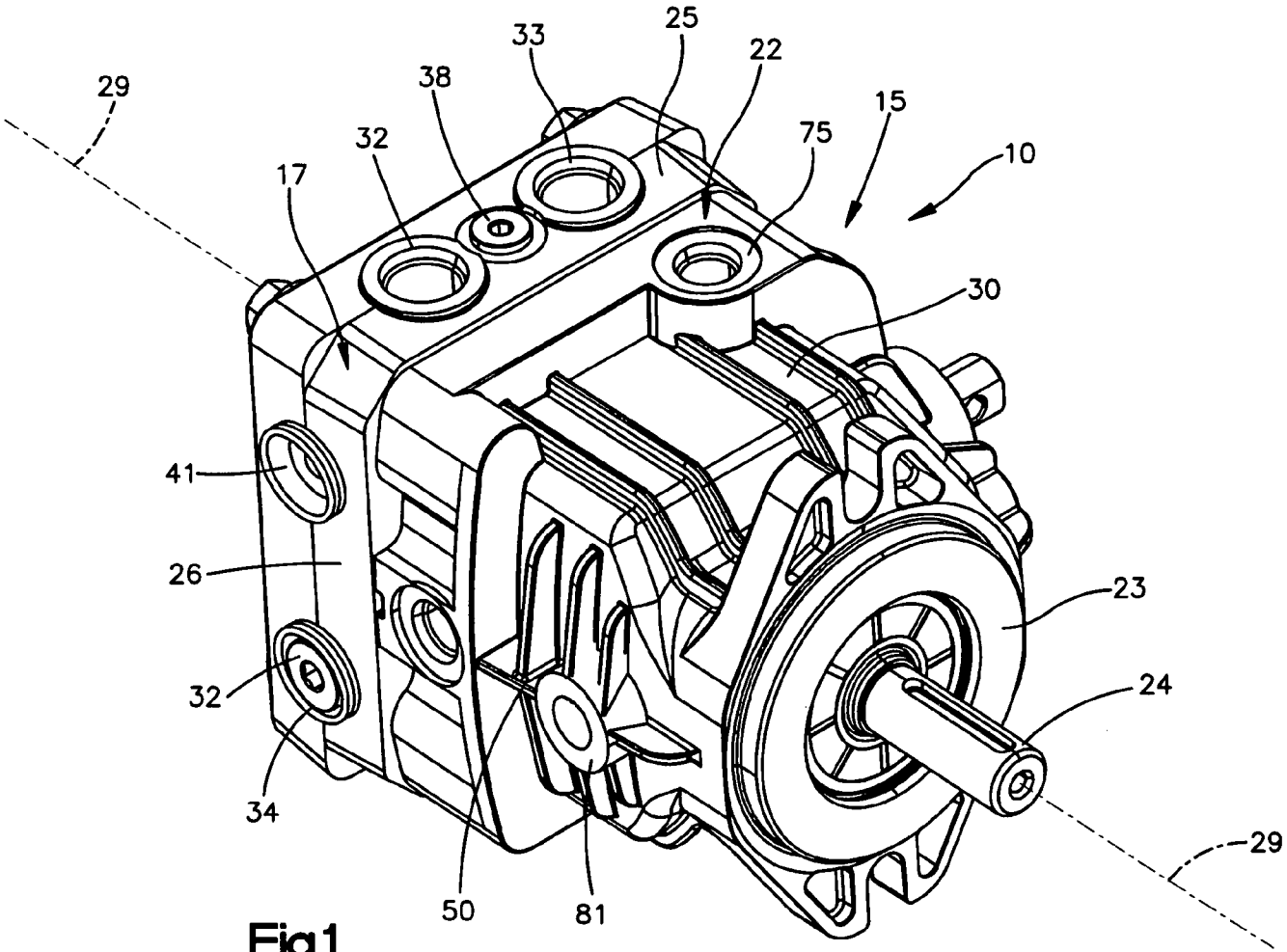
FIG. 1 shows an isometric view of a pump according to the present invention located in a first spatial orientation.

Referring to FIG. 1, pump 10 has a housing 15 and an affixed endcap 17. Endcap 17 is sealingly affixed to a first longitudinal end 22 of housing 15. A pump shaft 24 extends axially from a second longitudinal end 23 of housing 15. Endcap 17 not only seals one end of pump 10, but also houses components for controlling the fluid system and provides connection orifices for the motor (not shown). Specifically, endcap 17 includes an end cap first side surface 25 having a first system port 32 and a second system port 33 that provide connections with lines that fluidly interface with the motor. A diagnostic port 38 is located between ports 32, 33. Diagnostic port 38 leads to the outlet of the charge pump, not shown. It should be noted that cap first side surface 25 which contains ports 32, 33, 38 is basically an extension or continuation of a pump first side portion 30, i.e. cap first side 25 and pump first side portion 30 are substantially coplanar.

Endcap 17 further has a third system port 34 and a check valve orifice 41 located in an end cap second side surface 26 adjacent to one end of pump first side portion 30 at first port 32. Third system port 34 provides an alternative location for a connection with the motor if the pump is oriented in such a way that makes the fluid line routing more convenient. Third system port 34 would replace either first or second port 32, 33 depending on which side third system port is located. An endcap, or steel plug 36 is shown closing third port 34. Check valve orifice 41 leads to a bore that houses a check valve for controlling the charge pump make-up flow for the hydrostatic (closed-loop) transmission. Again, it should be noted that cap second side surface 26, which contains port 34 and check valve orifice 41, is substantially co-planar with a pump second side portion 50.

Figure 3:
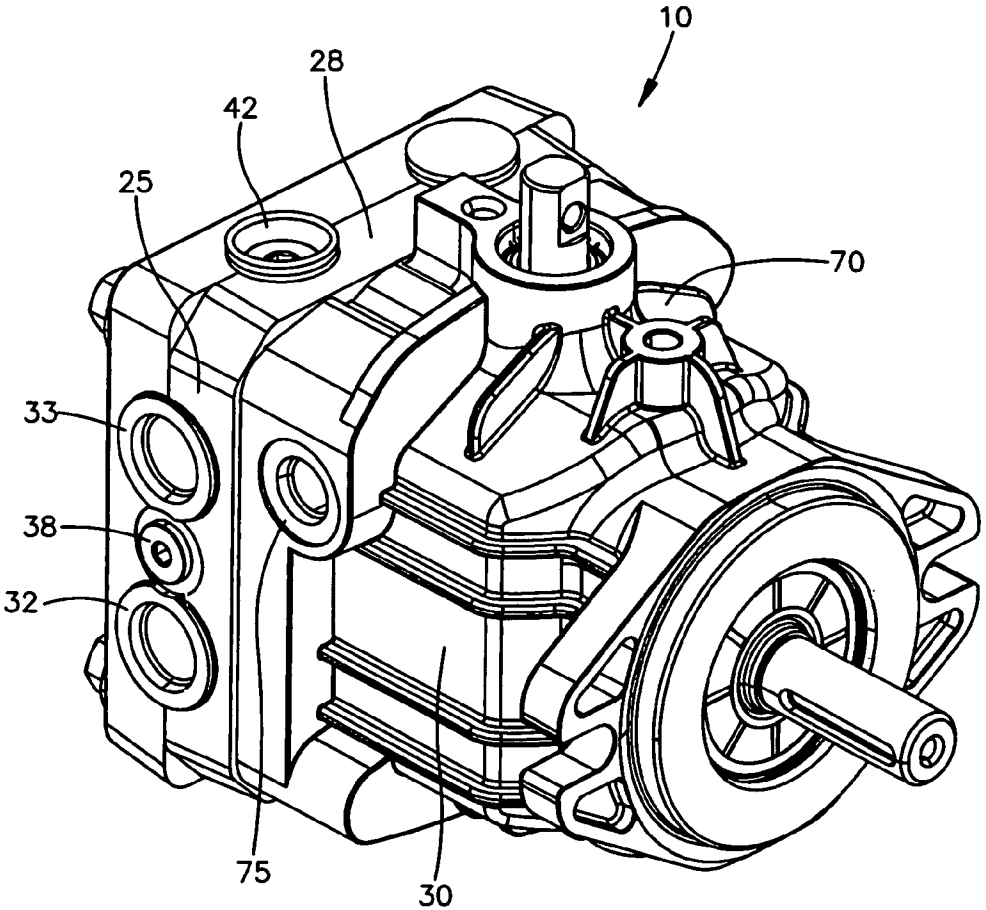
FIG. 3 shows an isometric view of the pump according to the present invention located in a third spatial orientation.

Referring now to FIG. 3, contained in an end cap fourth side surface 28, adjacent to another end of pump first side portion 30 at second port 33 is a second check valve orifice 42. Second check valve orifice 42 leads to a bore that houses a check valve for controlling the charge pump make-up flow. Yet again, it should be noted that cap fourth side surface 28, which contains second valve orifice 42 is substantially co-planar with a pump fourth side portion 70.

Referring back to FIG. 2, a bypass valve orifice 45 and a charge pump inlet port 47 are located in an endcap third side surface 27 adjacent to one end of pump fourth side surface 28, remote from second check valve orifice 42. This side of endcap 36 is directly opposite first and second system ports 32, 33. Bypass valve orifice 45 houses bypass valve 49 which is used to divert fluid from flowing through the pump in order to move the vehicle a short distance without engaging the engine. Charge pump inlet port 47 receives a fluid line from the system reservoir, not shown. Finally, it should be noted that cap third side surface 27, which contains bypass valve 49 and charge pump inlet orifice 47, is substantially co-planar with a pump third side portion 60. Advancing now to FIG. 4, this view basically details the intersection of adjacent pump second and third portions 50 and 60 as well as the intersections of adjacent end cap second and third side surfaces 26, 27.

Referring to FIGS. 1–4, pump housing 15 has six side portions. The axial ends are comprised of first and second longitudinal housing ends 22, 23. Located between these two ends 22, 23 are the four radial side portions 30, 50, 60 and 70. As discussed above, pump first side portion 30 is located on the same radial side as end cap first and second system ports 32, 33 in end cap first side surface 25. Adjacent first side portion 30 is second side portion 50 which is on the same radial side as end cap third system port 34 and first check valve orifice 41 in end cap second side surface 26. Adjacent pump second side portion 50 and opposite pump first side portion 30 is pump third side portion 60. Pump third side portion 60 is on the same radial side as end cap bypass valve orifice 45 and charge pump inlet port 47 in end cap third side surface 27. Adjacent pump third side portion 60 and directly opposite pump second side portion 50 is pump fourth side portion 70. Fourth side portion 70 is on the same radial side as end cap second check valve orifice 42 in end cap fourth side surface 28.

Figure 6:
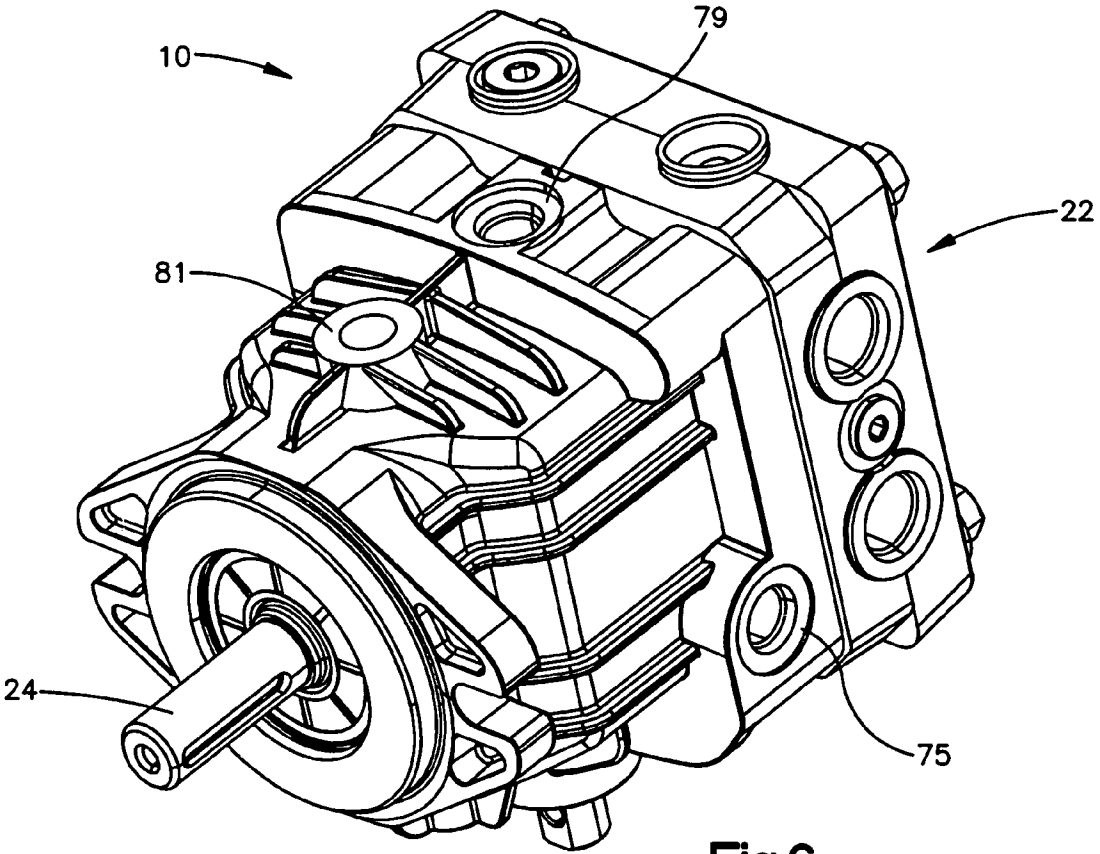
FIG. 6 shows an isometric view of the pump according to the present invention located in a sixth spatial orientation.

Looking at the orientation of pump 10 in yet another way, and using longitudinal axis 29 of pump shaft 24 as a reference line, the pump four radial side portions 30, 50, 60 and 70 are progressively shown in an upper horizontal surface portion in FIGS. 1, 3, 2 and 4, respectively, which represent successive 90° counterclockwise shifts, of pump 10, respectively. The spatial orientation of pump 10 within a piece of equipment can vary based on the overall design of the hydrostatic transmission. For example, one manufacturer may position pump 10 with side portion 30 facing up or substantially horizontally, as shown in FIG. 1. Alternatively, another manufacturer may position pump 10 such that the first longitudinal end 22 of housing 15 is positioned upwardly or substantially vertically, as shown in FIG. 6. Since there are six side portions, it is possible for any of these portions to be facing a certain spatial direction. Numerous connections are therefore possible with pump 10 and a correct alignment of pump 10 is necessary to mate with these connections. For example, a conduit may need to serve as the conductor of fluid between the motor and pump 10 and may need to be connected with first system port 32. It is most likely that the conduit is a hard plumbed pipe that ends in a fixed position. If pump 10 is not properly aligned so that first system port 32 mates with the conduit, then an adapter and excess conduit is needed for a connection. Each port on pump 10 requires this same precise alignment.

As is well known in the art internal leakage within the pump, caused by high pressure and lubrication, flows directly into the pump case. This leaking fluid then flows from the pump case to low pressures case drain lines which serve as drains for diverting excess fluid to a reservoir in order to reduce pressure in the pump. Pump 10 has multiple case drain ports so that a convenient connection can be made with the drain line conduit in any spatial orientation of the pump. Although the case drain conduit line can be initially routed to mate with any side of pump 10, once the case drain conduit line is set, it is important that the pump (and any subsequent replacement pump) have a mating port aligned with the case drain conduit line. The following discussion and related FIGS. 1–6 presume that the case drain conduit line is routed to mate with the top side of pump 10.

Figure 2:
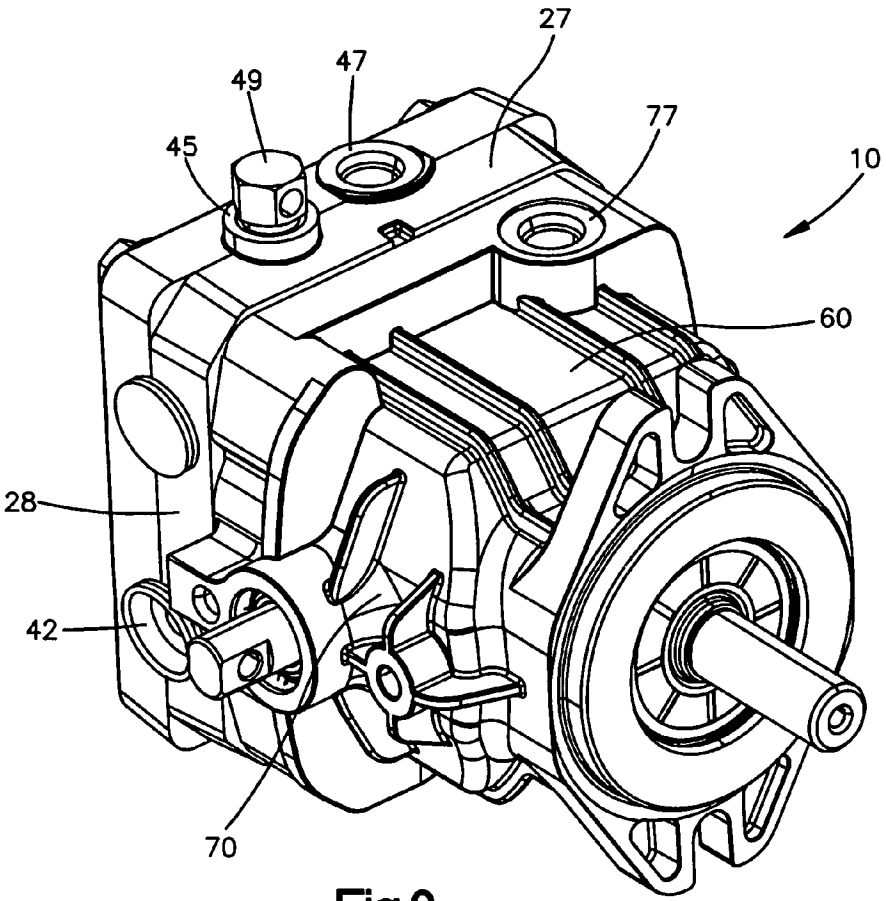
FIG. 2 shows an isometric view of the pump according to the present invention located in a second spatial orientation.
Figure 4:
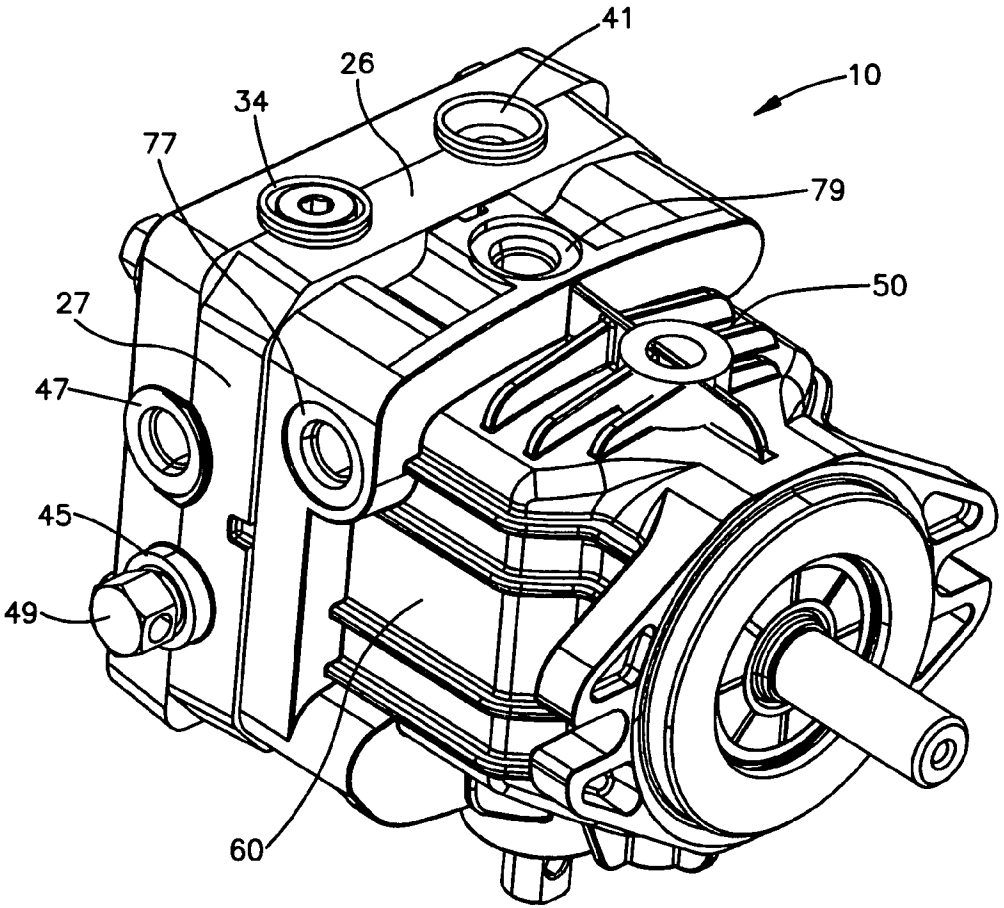
FIG. 4 shows an isometric view of the pump according to the present invention located in a fourth spatial orientation.

When pump 10 is oriented as shown in FIG. 1 with pump first side portion 30 upwardly directed, or in substantially horizontal position, a first case drain 75 is located at the top of pump 10 so that a convenient connection can be made. Likewise, when pump 10 is oriented as shown in FIG. 2 with pump third side portion 60 upwardly directed, a second case drain 77 is located at the top of pump 10. Similarly, when pump 10 is oriented as shown in FIG. 3 with pump fourth side portion 70 upwardly directed, again first case drain 75 is located near the top of pump 10 so a convenient connection can again be made. Alternatively, when pump 10 is oriented as shown in FIG. 4 with pump second side portion 50 positioned upwardly, a third case drain 79 is located in the vicinity of the top of pump 10. Case drain 77 could also be used when pump is oriented as shown in FIG. 4.

Figure 5:
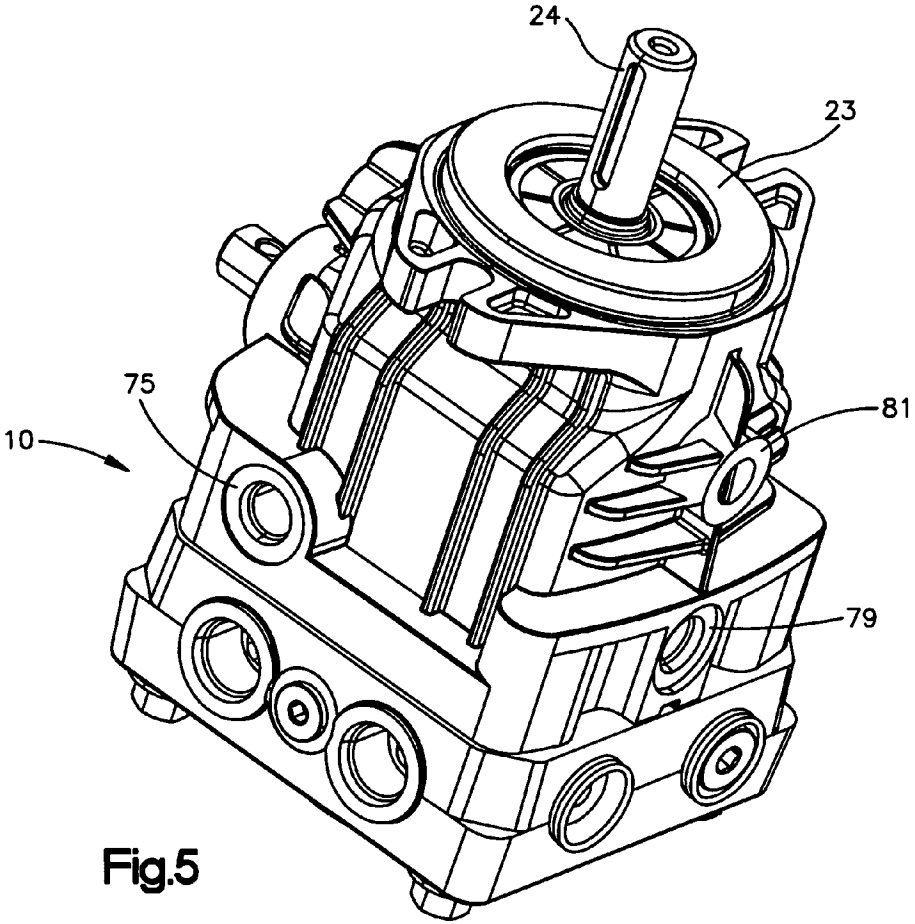
FIG. 5 shows an isometric view of the pump according to the present invention located in a fifth spatial orientation.

If pump 10 is oriented as shown in FIG. 5 with pump shaft 24 positioned upwardly and second longitudinal end 23 in a vertically upper position, a fourth case drain 81 is located near the top of pump 10 for easy connection. When pump 10 is oriented as shown in FIG. 6 with pump shaft 24 positioned downwardly and first longitudinal end 22 in a vertically upper position, case drains 77 (not shown in that view), 79 and 75 can be used for the case drain conduit line connection. It should be noted that the generally vertical orientations shown in FIGS. 5 and 6 are limited to light duty pumps. Due to the weight of conventional pumps, they are typical installed horizontally, i.e. with the pump shaft in generally horizontally oriented axis, as shown in FIGS. 1–4.

With the spatial arrangements of case drain ports (75, 77, 79, and 81), the case drain conduit line does not have to be inconveniently redirected or lengthened since a port (75, 77, 79, and 81) is in close proximity to the hard plumbed case drain conduit line. Although the above description discussed in regard to an example where the case drain conduit line is directed to mate with the top side of pump 10, the same convenient mating occurs when the case drain conduit line is positioned on any side of pump 10. However, it should be noted that linking the case drain conduit line to the a port on top of the housing will improve the lubrication of the internal rotary components of pump 10 and carry away any debris for better contamination control. This extends the endurance life of pump 10.

It should be noted that the present invention is not limited to the specified preferred embodiments and principles. Those skilled in the art to which this invention pertains may formulate modifications and alterations to the present invention. These changes, which rely upon the teachings by which this disclosure has advanced, are properly considered within the scope of this invention as defined by the appended claims.

What is claimed is:

1. A housing for a variable displacement hydraulic pump having a total of six side portions comprised of an open first longitudinal end, a spaced, open second longitudinal end, and four adjoining radial sides connecting said longitudinal ends, and a porting system with four case drains such that an orifice for each of said case drains is located in the vicinity of the top surface of said housing when any one of said six sides is so spatially positioned that it occupies an upwardly directed generally horizontal surface position.

2. The housing as in claim 1 wherein said variable displacement pump is of a light duty variety.

3. A housing for a variable displacement hydraulic pump comprising multiple external surfaces and including at least three case drain orifices, with at least two differing ones of said external surfaces having at least one of said at least three case drain orifices.

4. The housing as in claim 3 wherein said pump is a light duty pump.

5. The housing as in claim 4 wherein one of said case drain orifices is located in the vicinity of an upwardly-directed generally horizontal surface position, regardless of the spatial orientation of said housing.

6. The housing as in claim 4 wherein one of said case drain orifices is located at an upper-most section of said housing in any spatial orientation of said housing.

7. The housing as in claim 4 wherein one of said case drain orifices is located at the bottom-most section of said housing in any spatial orientation of said housing.

8. A light duty, variable displacement hydraulic pump having a multi-sided surface housing and an attached endcap wherein said housing has at least one case drain orifice in differing ones of at least three housing surfaces, said orifices being located near an upper-most surface of said pump in any spatial orientation of said pump.

9. In a variable displacement hydraulic pump having a housing with a multiplicity of interconnected surfaces, including opposed end surfaces and intermediate side surfaces, the improvement comprising at least three case drain orifices with at least one case drain orifice in each of a two differing ones of said surfaces in a manner such that at least one of said orifices is located in the vicinity of the top surface of said housing in any spatial orientation of said housing.

10. The improved housing of claim 9, wherein said variable displacement hydraulic pump is of a light duty variety.

11. The improved housing of claim 9, wherein said housing includes two end surfaces and a plurality of intermediate side surfaces.

12. The improved housing of claim 11, wherein said case drain orifices are located within at least some of said plurality of intermediate side surfaces.

13. The improved housing of claim 12 wherein said at least some of said plurality of intermediate side surfaces is no less than three.

* * * * *